US006373367B1

(12) United States Patent
Lu

(10) Patent No.: US 6,373,367 B1
(45) Date of Patent: Apr. 16, 2002

(54) FLYBACK TRANSFORMER WITH CORE GROUNDED

(75) Inventor: Shao An Lu, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/497,323

(22) Filed: Feb. 3, 2000

(30) Foreign Application Priority Data

Dec. 27, 1999 (TW) ..... 088123056

(51) Int. Cl.[7] ..... H01F 27/30
(52) U.S. Cl. ..... 336/198; 336/96; 336/107
(58) Field of Search ..... 336/192, 198, 336/96, 185, 107

(56) References Cited

U.S. PATENT DOCUMENTS 4,246,636 A * 1/1981 Kawamura et al. ..... 363/146
4,475,097 A * 10/1984 Kikuchi ..... 336/192
4,499,522 A * 2/1985 Nakamura ..... 361/836
5,798,682 A * 8/1998 Kim et al. ..... 336/96
5,898,354 A * 4/1999 Lee ..... 336/96

* cited by examiner

*Primary Examiner*—Anh Mai
(74) *Attorney, Agent, or Firm*—Oppenheimer Wolff & Donnelly, LLP

(57) ABSTRACT

The present invention provides a flyback transformer comprising a core, a low-voltage bobbin and a conductive device. The core comprises an upper core and a lower core. The low-voltage bobbin comprises a skirt. The skirt has a lower opening for receiving the lower core and a grounding pin is provided on a side portion of the skirt. The conductive device comprises an U-shaped body, an input end and an output end. The U-shaped body is engaged with the side portion of the skirt. The input end is provided on one end of the U-shaped body for flexibly connecting the lower core. The output end is provided on the other end of the U-shaped body for connecting the grounding pin. The core is grounded by the way of connecting the lower core and the grounding pin through the conductive device.

14 Claims, 8 Drawing Sheets

FLYBACK TRANSFORMER WITH CORE GROUNDED

FIELD OF THE INVENTION

The present invention relates to a flyback transformer, and more particularly, to a flyback transformer with a core grounded.

BACKGROUND OF THE INVENTION

A flyback transformer is generally implemented within the circuits of a display device for providing distinctive voltages required by the circuits operation of the display device. Some U.S. Patents, i.e. U.S. Pat. Nos. 5,160,872, 5,287,479, 4,144,480 and 4,475,097 may be referred in order to have an in-depth understandings of structures of the flyback transformer and functions of High Voltage output, Focus output and Screen output of the flyback transformer.

Please refer to FIGS. 1 and 2. FIG. 1 is a schematic diagram of a flyback transformer 10 according to the prior art. FIG. 2 is an exploded diagram of the flyback transformer 10 shown in FIG. 1. A flyback transformer 10 of the prior art comprises a low-voltage bobbin 12, a high-voltage bobbin 14, an upper core 16, a lower core 18, a housing 20 and a clip 22. The assembly procedure of the flyback transformer 10 comprises: first, installing a winding shaft (not shown) of the low-voltage bobbin 12 into a shaft hole (not shown) of the high-voltage bobbin 14; secondly, installing the low-voltage bobbin 12 and high-voltage bobbin 14 into the housing 20; finally, mounting the upper and lower cores 16, 18 on the low-voltage bobbin 12 by the clip 22 to form the flyback transformer 10.

Please refer to FIG. 3. FIG. 3 is an assembly diagram of the low-voltage bobbin 12, clip 22 and upper and lower cores 16, 18. The clip 22 is formed of a thicker metal wire rod, such as stainless or piano wire, subjected to surface treatment, such as galvanization or tinning and bent in a U-shape, a grounding end 24 being bent from and integral with the lower end of clip 22. And then, the grounding end 24 is mounted onto a predetermined bore of a printed substrate (not shown) for grounding the upper and lower cores 16, 18. In addition, fitting holders 28 are provided on the outer surface of low-voltage bobbin 12 as shown in FIG. 3 and a positioning fitting 26 is fitted onto the low-voltage bobbin 12 and fixed at both ends to the fitting holders 28 for positioning the grounding end 24. Nevertheless, the positioning fitting 26 really provides the grounding end 24 with high positional accuracy, it always leads to increase product cost and assembly complexity of the flyback transformer 10. So the positioning fitting 26 is not used extensively for the flyback transformer 10.

SUMMARY OF THE INVENTION

It is therefore a primary objection of the present invention to provide a flyback transformer with a core grounded to solve the above mentioned problem.

In a preferred embodiment, the present invention provides a flyback transformer comprising a core, a low-voltage bobbin and a conductive device. The core comprises an upper core and a lower core. The low-voltage bobbin comprises a skirt. The skirt has a lower opening for receiving the lower core and a grounding pin is provided on a side portion of the skirt. The conductive device comprises an U-shaped body, an input end and an output end. The U-shaped body is engaged with the side portion of the skirt. The input end is provided on one end of the U-shaped body for flexibly connecting the lower core. The output end is provided on the other end of the U-shaped body for connecting the grounding pin. The core is grounded by the way of connecting the lower core and the grounding pin through the conductive device.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERED EMBODIMENT

Figure 1:
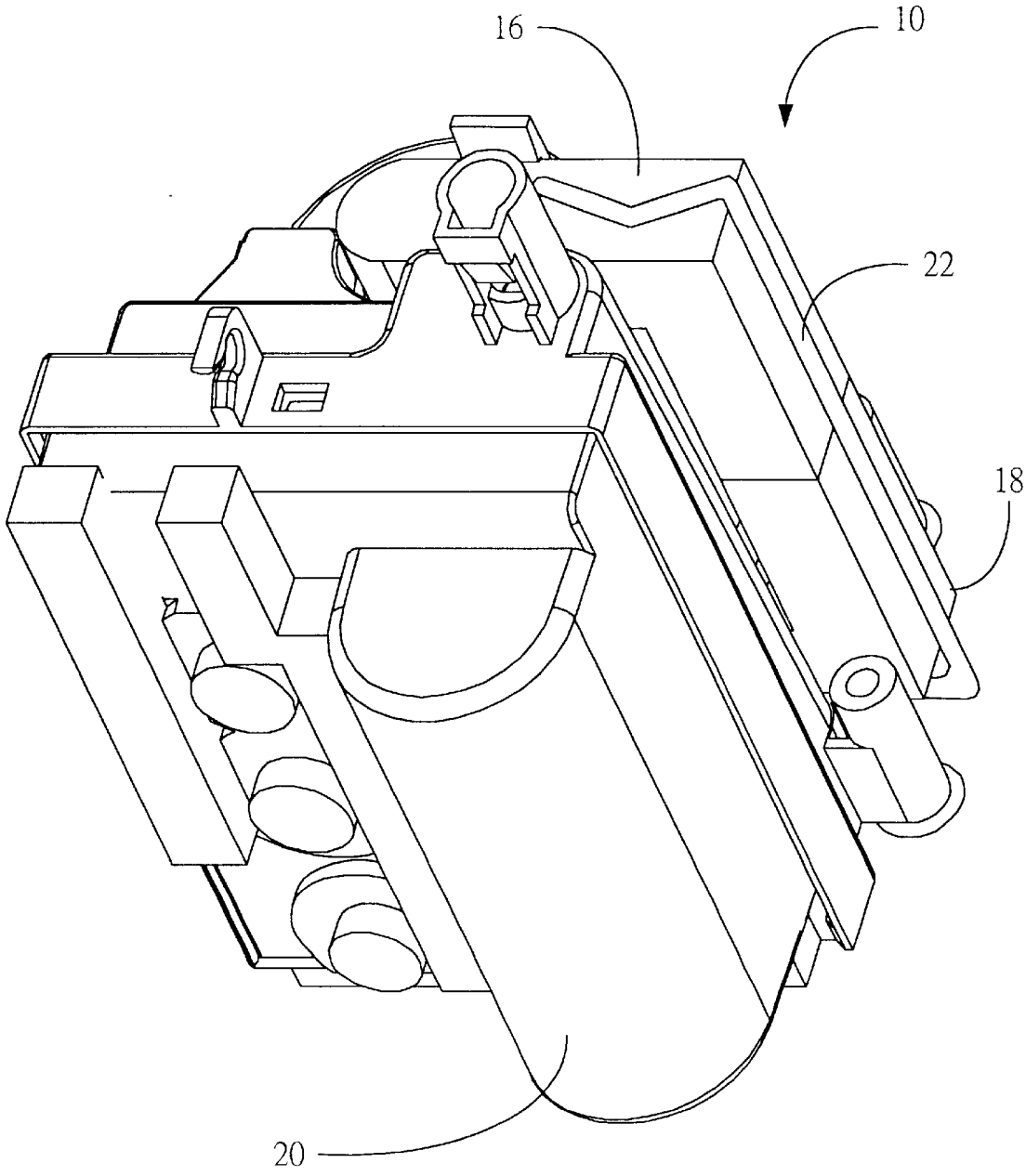
Fig. 1 Prior Art
FIG. 1 is a schematic diagram of a flyback transformer according to the prior art.
Figure 2:
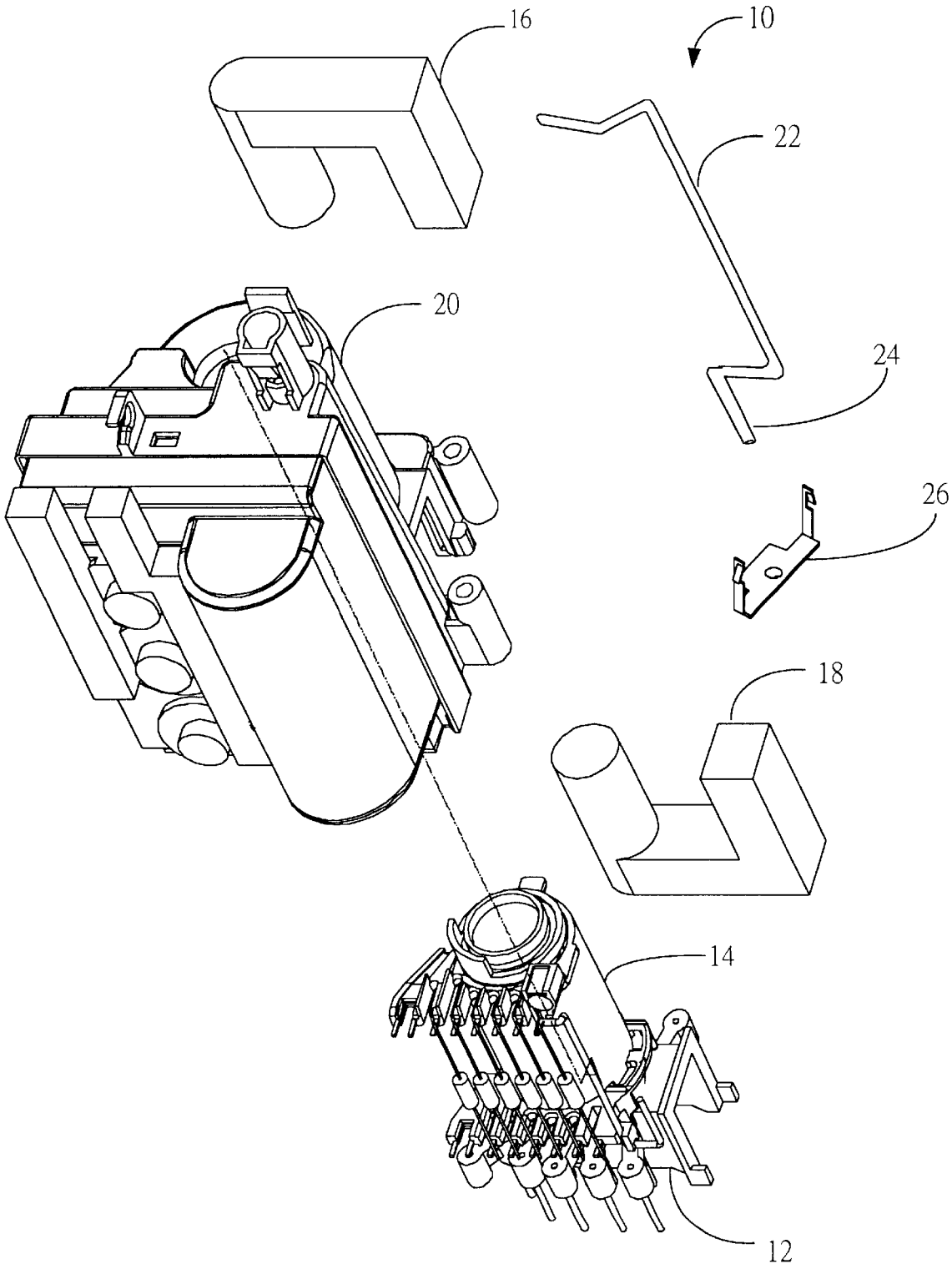
Fig. 2 Prior Art
FIG. 2 is an exploded diagram of the flyback transformer shown in FIG. 1.
Figure 3:
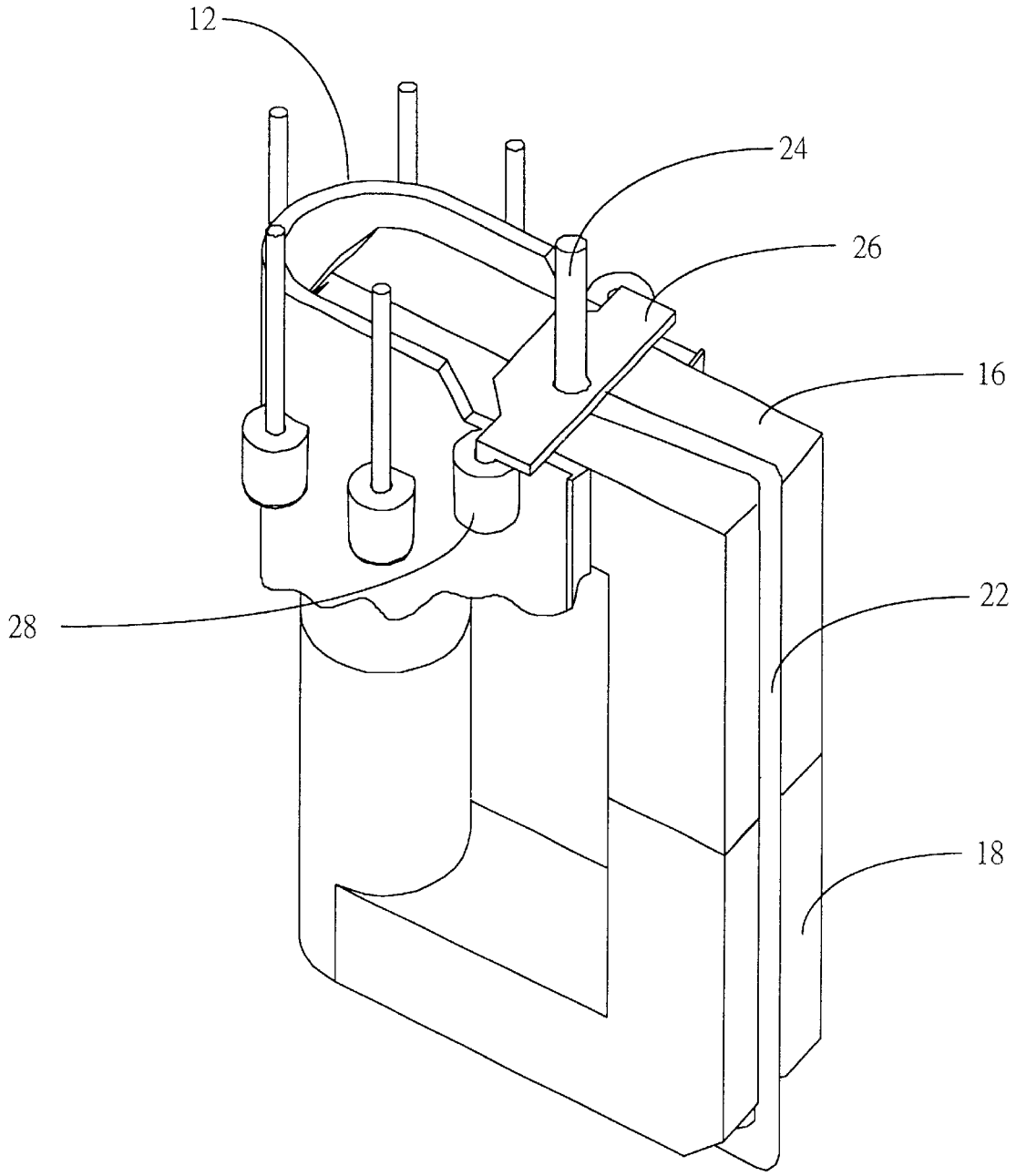
Fig. 3 Prior Art
FIG. 3 is an assembly diagram of the low-voltage bobbin, clip and upper and lower cores shown in FIG. 1.
Figure 4:
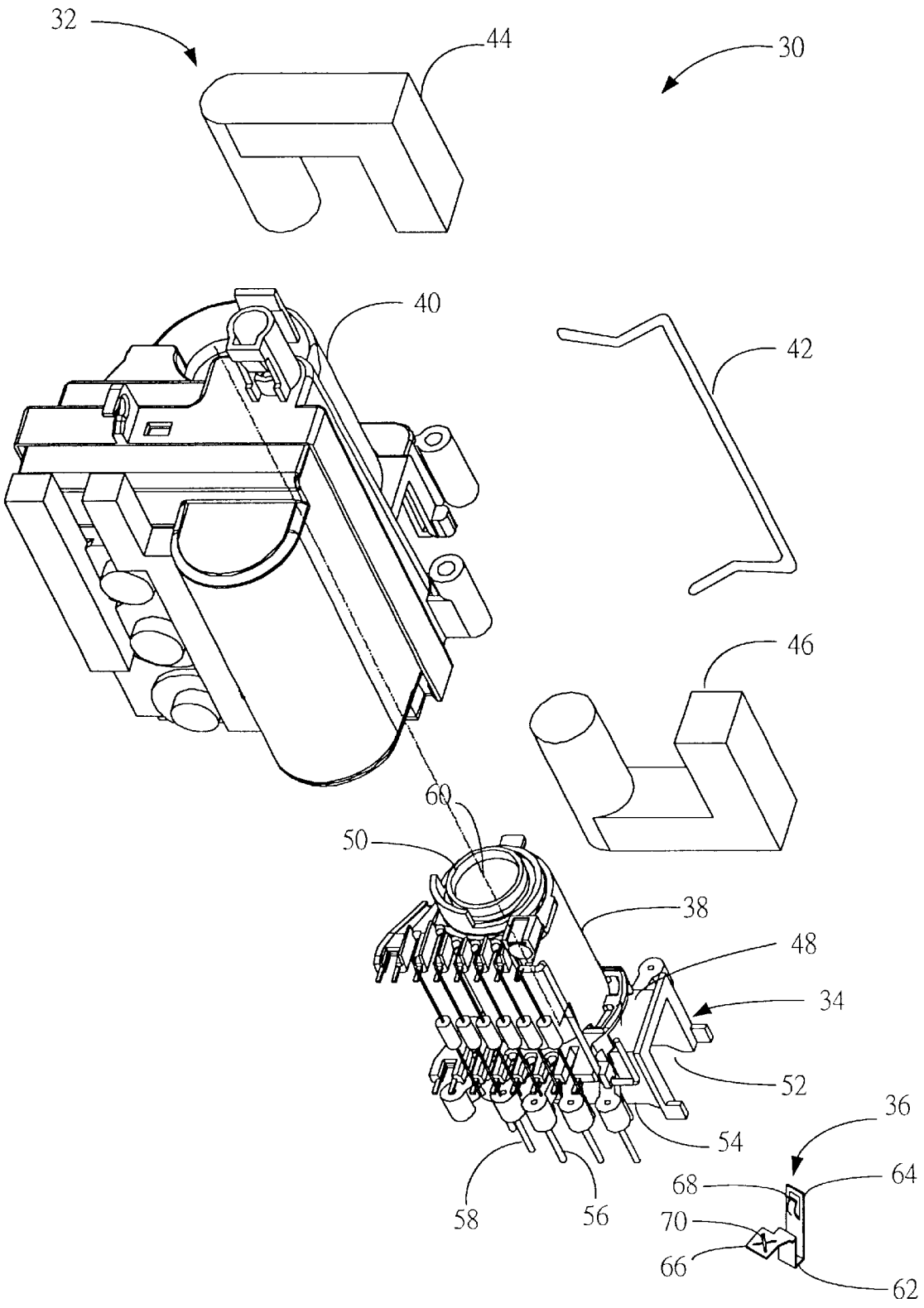
FIG. 4 is an assembly diagram of a flyback transformer according to the present invention.

Please refer to FIG. 4. FIG. 4 is an assembly diagram of a flyback transformer 30 according to the present invention. Flyback transformer 30 of the present invention comprises a core 32, a low-voltage bobbin 34 and a conductive device 36. The core 32 comprises an upper core 44 and a lower core 46. The low-voltage bobbin 34 comprises a skirt 48 and a winding shaft 50. The skirt 48 has a lower opening 52 for receiving the lower core 46 and a plurality of terminal pins 56 are provided on a side portion 54 of the skirt 48. One of the terminal pins 56 is a grounding pin 58 for serving as a grounding end of the low-voltage bobbin 34. The winding shaft 50 is provided on the skirt 48 and has an upper opening 60 for receiving the upper core 44.

Figure 5:
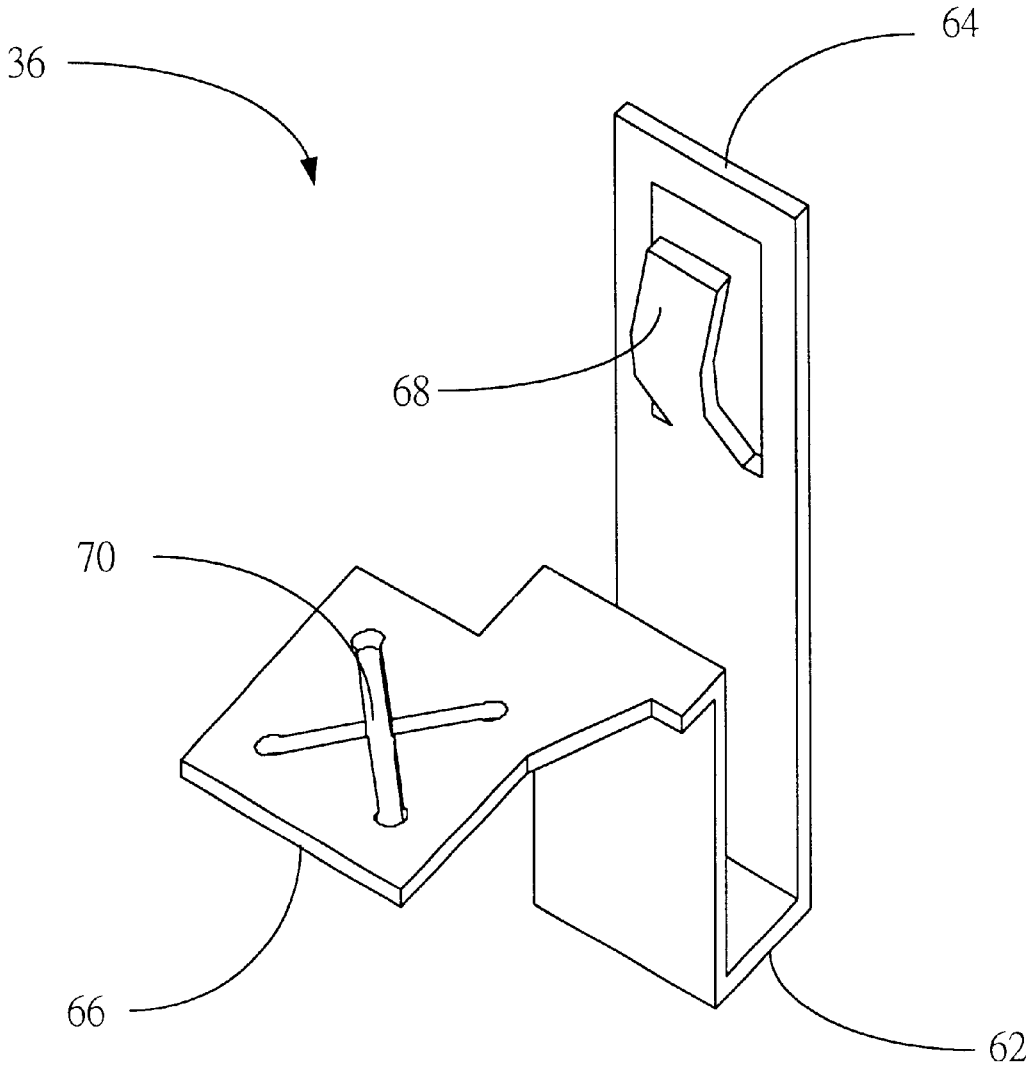
FIG. 5 is a schematic diagram of the conductive device shown in FIG. 4.
Figure 6:
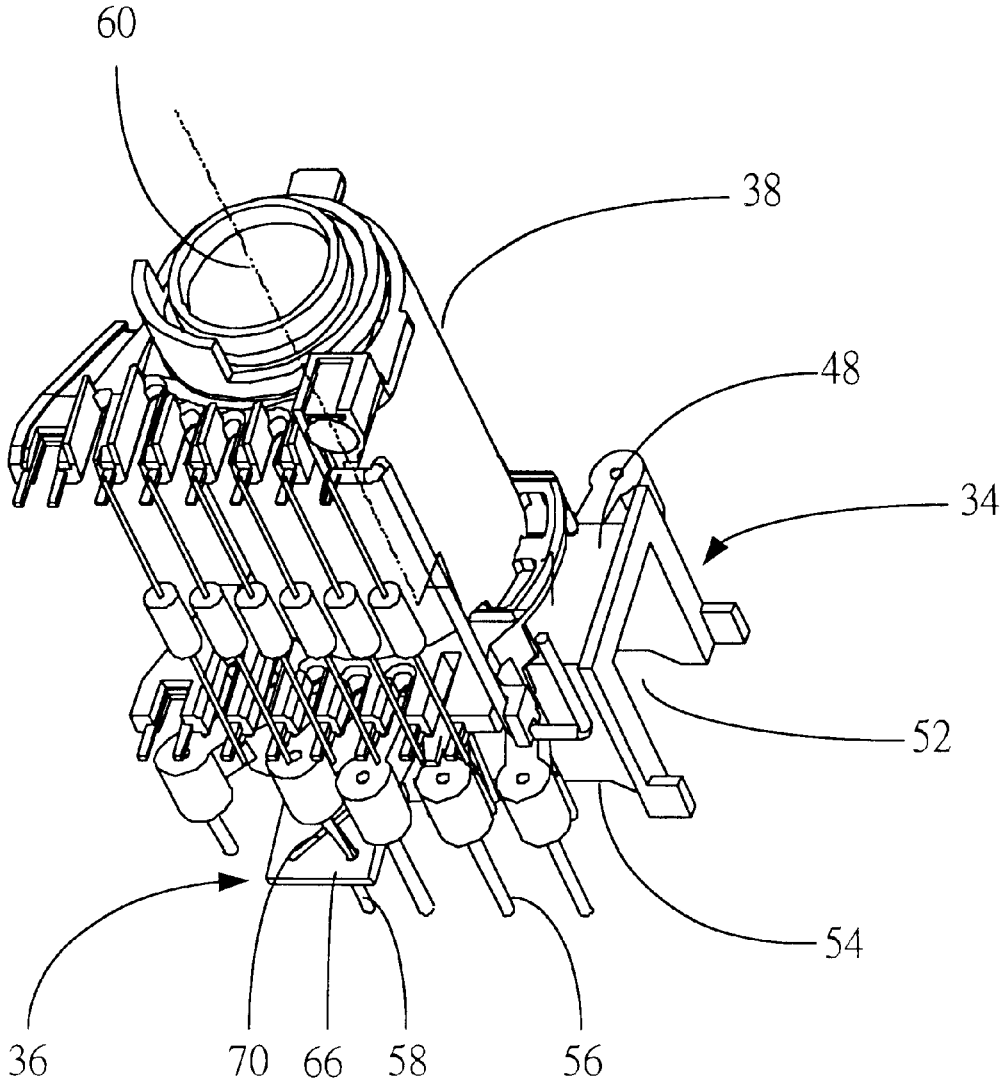
FIG. 6 is an assembly diagram of the conductive device and the low-voltage bobbin shown in FIG. 4.

Please refer FIGS. 5 and 6. FIG. 5 is a schematic diagram of the conductive device 36 shown in FIG. 4. FIG. 6 is an assembly diagram of the conductive device 36 and the low-voltage bobbin 34 shown in FIG. 4. The conductive device 36 comprises an U-shaped body 62, an input end 64 and an output end 66. The U-shaped body 62 is engaged with the side portion 54 of the skirt 48 as shown in FIG. 6. The input end 64 is integrally formed on one end of the U-shaped body 62 in parallel for flexibly connecting the lower core 46. And the input end 64 can be a hollow member having a flat spring 68 as shown in FIG. 5. The output end 66 is integrally formed on the other end of the U-shaped body 62 in vertical for connecting the grounding pin 58. And the output end 66 can be a hollow member having a cross opening 70 as shown in FIG. 5. Moreover, the grounding pin 58 can be connected to the conductive device 36 through the cross opening 70 of the output end 66 as shown in FIG. 6. Finally, the core 32 is grounded by the way of connecting the lower core 46 and the grounding pin 58 concurrently through the conductive device 36.

Please refer to FIG. 4. The flyback transformer 30 further comprises a high-voltage bobbin 38, a housing 40 and a clip 42. The assembly procedure of the flyback transformer 30 comprises: first, engaging the conductive device 36 with the low-voltage bobbin 34, and concurrently mounting the grounding pin 58 on the output end 66 through the cross opening 70; secondly, installing the winding shaft 50 of the low-voltage bobbin 34 into a shaft hole (not shown) of the high-voltage bobbin 38; then, installing the high-voltage bobbin 38 and low-voltage bobbin 34 into the housing 40; finally, mounting the upper core 44 and the lower core 46 on the low-voltage bobbin 34 through the winding shaft 50 and the skirt 48 respectively by the clip 42.

The flyback transformer 30 of the present invention applies the conductive device 36 for concurrently connecting the lower core 46 and the grounding pin 58. The core 32 mounted on the low-voltage bobbin 34 by the clip 42 will be grounded through the conductive device 36 for improvement of the product stability and productivity. In addition, the clip 42 applied by the flyback transformer 30 of the present invention only provides the mounting function of the core 32. Stainless wire such as SUS305 can directly serve as the clip material for the purpose of cost reduction because surface treatment is not subjected to the clip 42.

Figure 7:
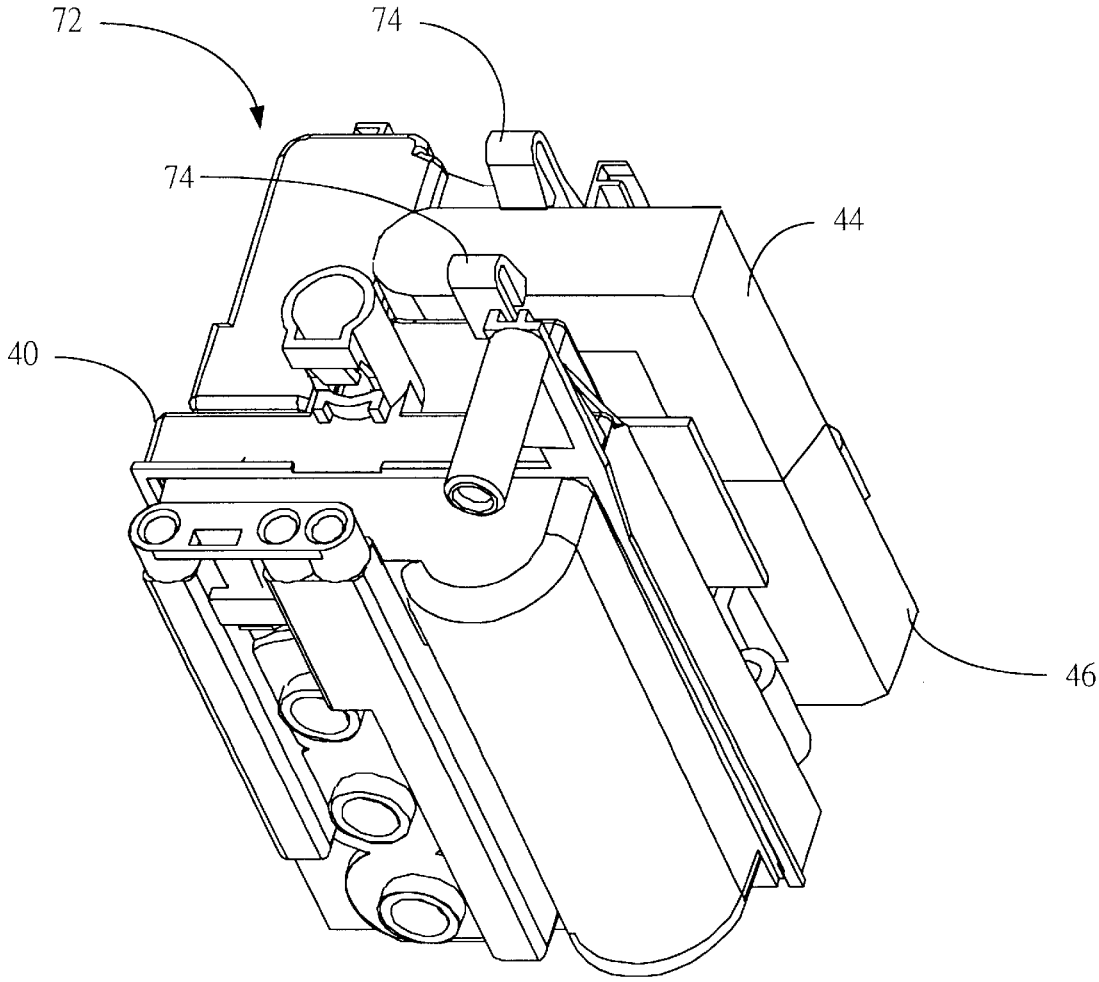
FIG. 7 is another embodiment of the flyback transformer.
Figure 8:
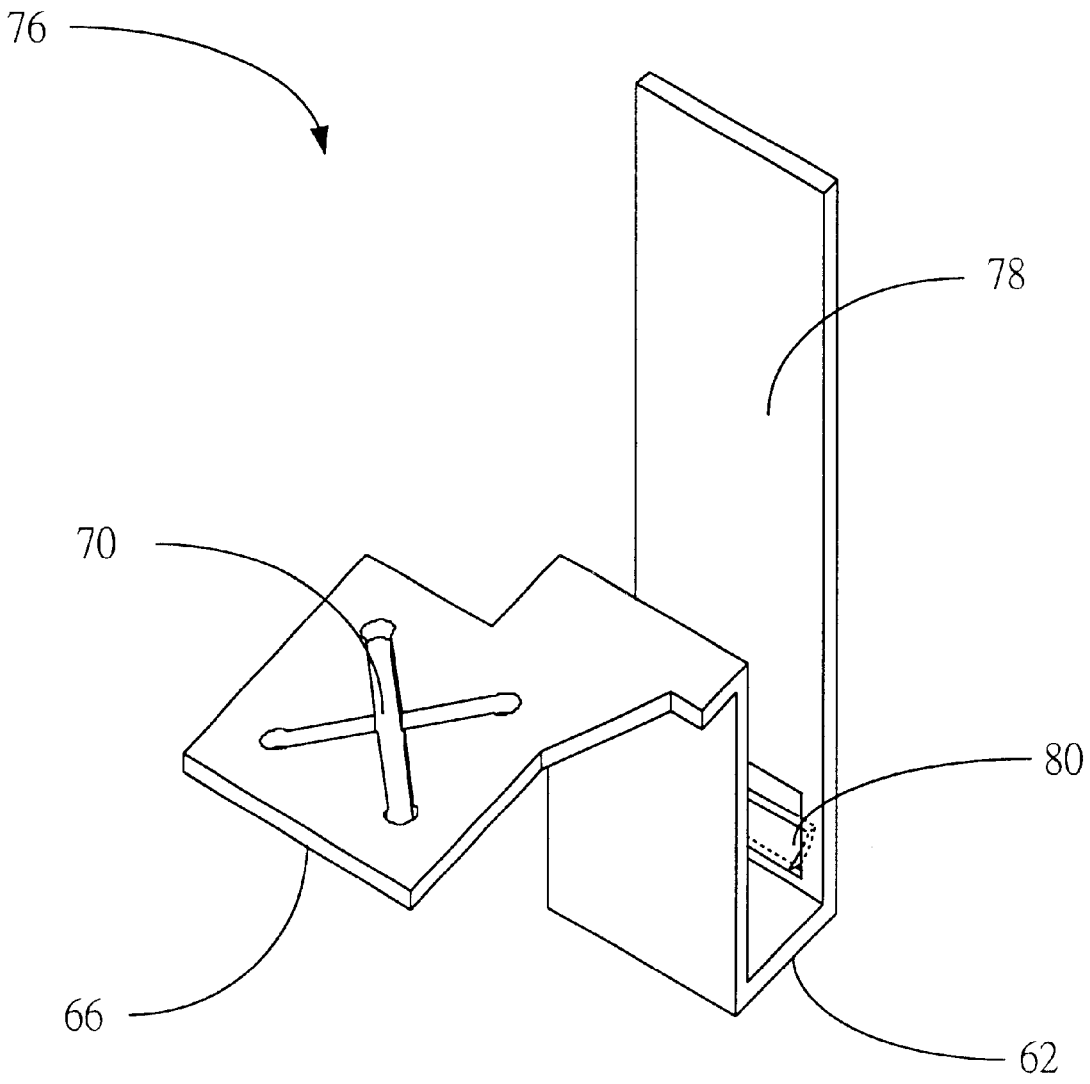
FIG. 8 is another embodiment of the conductive device.

Please refer to FIGS. 7 and 8. FIG. 7 is another embodiment of the flyback transformer 72. FIG. 8 is another embodiment of the conductive device 76. Another embodiment of the present invention provides a flyback transformer 72 further comprising two mounting devices 74. Each mounting device 74 is provided on the housing 40 for mounting the upper core 44 on the low-voltage bobbin 34 as shown in FIG. 7. Due to the flat spring 80 is provided on the input end 78 of the conductive device 76, the input end 78 can not only serve as flexibly connecting the lower core 34 but also serve as mounting the lower core 46 on the low-voltage bobbin 34. The clip 42 can be replaced by the mounting device 74 and input end 78 for mounting the core 32 on the low-voltage bobbin 34. The product cost of the flyback transformer 72 can also be reduced according to the present invention.

The assembly procedure of the flyback transformer 72 comprises: first, engaging the conductive device 36 with the low-voltage bobbin 34, and concurrently mounting the grounding pin 58 on the output end 66 through the cross opening 70; secondly, installing the winding shaft 50 of the low-voltage bobbin 34 into a shaft hole (not shown) of the high-voltage bobbin 38; then, installing the high-voltage bobbin 38 and low-voltage bobbin 34 into the housing 40; finally, mounting the upper core 44 on the low-voltage bobbin 34 through the winding shaft 50 by the mounting devices 74, and concurrently mounting the lower core 46 on the low-voltage bobbin 34 through the skirt 48 by the flat spring 80 of the input end 78.

In contrast to the flyback transformer 10 of the prior art, the flyback transformer 30 of the present invention applies the conductive device 36 for concurrently connecting the lower core 46 and the grounding pin 58. The core 32 mounted on the low-voltage bobbin 34 by the clip 42 will be grounded through the conductive device 36 for improvement of the product stability and productivity. In addition, the clip 42 applied by the flyback transformer 30 of the present invention only provides the mounting function of the core 32. Stainless wire such as SUS305 can directly serve as the clip material for the purpose of cost reduction. Finally, the clip 42 can be replaced by the mounting device 74 and input end 78 for mounting the core 32 on the low-voltage bobbin 34 according to the flyback transformer 72 of the present invention. The product cost can also be reduced.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A flyback transformer comprising:

a core comprising a upper core and a lower core;

a low-voltage bobbin comprising a skirt and a winding shaft, the skirt having a lower opening for receiving the lower core and a grounding pin provided on a side portion of the skirt, the winding shaft being provided on the skirt and having an upper opening for receiving the upper core; and a conductive device for connecting the lower core and the grounding pin, wherein the conductive device comprises:

a U-shaped body engaged with the side portion of the skirt;

an input end provided on one end of the U-shaped body for flexibly connecting the lower core; and an output end provided on the other end of the U-shaped body for connecting the grounding pin.

2. The flyback transformer of claim 1 wherein the input end is integrally formed on one end of the U-shaped body in parallel.

3. The flyback transformer of claim 1 wherein the output end is integrally formed on the other end of the U-shaped body in vertical.

4. The flyback transformer of claim 1 wherein the input end is a hollow member having a flat spring.

5. The flyback transformer of claim 1 wherein the output end is a hollow member having a cross opening.

6. The flyback transformer of claim 5 wherein the grounding pin is connected to the conductive device through the cross opening.

7. The flyback transformer of claim 6 wherein the flyback transformer further comprises a high-voltage bobbin, a housing and a clip, the assembly procedure of the flyback transformer comprises:

engaging the conductive device with the low-voltage bobbin, and concurrently mounting the grounding pin on the output end through the cross opening;

installing the winding shaft of the low-voltage bobbin into a shaft hole of the high-voltage bobbin;

installing the high-voltage bobbin and low-voltage bobbin into the housing; and mounting the upper core and the lower core on the low-voltage bobbin through the winding shaft and the skirt respectively by the clip.

8. The flyback transformer of claim 6 wherein the flyback transformer further comprises a high-voltage bobbin, a housing and at least one mounting device, the mounting device is provided on the housing, the assembly procedure of the flyback transformer comprises:

engaging the conductive device with the low-voltage bobbin, and concurrently mounting the grounding pin on the output end through the cross opening;

installing the winding shaft of the low-voltage bobbin into a shaft hole of the high-voltage bobbin;

installing the high-voltage bobbin and low-voltage bobbin into the housing; and mounting the upper core on the low-voltage bobbin through the winding shaft by the mounting device, and concurrently mounting the lower core on the low-voltage bobbin through the skirt by the input end of the conductive device.

9. A flyback transformer comprising:

a first bobbin comprising a skirt, the skirt having a side portion and an opening;

a core disposed within the opening;

a grounding pin formed on the side portion; and a conductive device comprising a substantially U-shaped body receiving the side portion of the skirt for attaching the conductive device onto the first bobbin;

an input end formed on a first end of the substantially U-shaped body and extended within the opening; and an output end formed on a second end of the substantially U-shaped body and extended outside the opening;

wherein the input end engages with the core to form a first electrical conduction between the core and the input end; and wherein the output end extends toward the grounding pin to form a second electrical conduction between the grounding pin and the output end.

10. The flyback transformer of claim 9 wherein the input end is integrally formed on one end of the substantially U-shaped body in parallel.

11. The flyback transformer of claim 9 wherein the output end is integrally formed on the other end of the substantially U-shaped body in vertical.

12. The flyback transformer of claim 9 wherein the input end is a hollow member having a flat spring.

13. The flyback transformer of claim 9 wherein the output end is a hollow member having a cross opening.

14. The flyback transformer of claim 13 wherein the grounding pin is connected to the conductive device through the cross opening.

* * * * *